US007000555B1

(12) United States Patent
Buchner

(10) Patent No.: US 7,000,555 B1
(45) Date of Patent: Feb. 21, 2006

(54) MAST EXTENDER FOR A SAILBOAT

(76) Inventor: Ragner Buchner, 512 Drake Ave., Roselle, NJ (US) 07203

( * ) Notice: Subject to any disclaimer, the term of this patent is extended or adjusted under 35 U.S.C. 154(b) by 0 days.

(21) Appl. No.: 11/096,352

(22) Filed: Apr. 1, 2005

(51) Int. Cl.
*B63B 15/00* (2006.01)

(52) U.S. Cl. ..... 114/90

(58) Field of Classification Search ..... 114/90, 114/102.1, 102.18, 102.21, 102.2, 102.5, 114/102.19, 109, 111, 102.12
See application file for complete search history.

(56) References Cited

U.S. PATENT DOCUMENTS 438,076 A * 10/1890 Hayden ..... 114/111
4,718,369 A * 1/1988 Pollard ..... 114/90

FOREIGN PATENT DOCUMENTS

DE 3714303 A1 * 11/1988

* cited by examiner

*Primary Examiner*—Jesus D. Sotelo
(74) *Attorney, Agent, or Firm*—Ezra Sutton, Esq.

(57) ABSTRACT

A mast extender for extending a mast of a sailboat to a greater height. The mast extender includes a hollow tubular member having a distal end and a proximal end and being substantially elliptically-shaped. The distal end of the hollow tubular member includes a sealed end. The hollow tubular member includes the sealed end, a first curved side wall, a second curved side wall, curved end walls, and an interior wall surface for forming an interior mast compartment. The proximal end of the hollow tubular member includes a mast receiving opening having a watertight gasket fixedly attached to the interior wall surface and the watertight gasket is adjacent to the mast receiving opening. The first and second curved side walls include aligned fastening bolt openings. The mast extender further includes a fastening bolt extending through the fastening bolt openings and a hex nut for fastening the fastening bolt thereon. The mast extender also includes a distal tip end on an original mast for insertion through the mast receiving opening within the interior mast compartment; and the distal tip end of the original mast includes a tip opening for receiving the fastening bolt therethrough in order to detachably connect the hollow tubular member and the distal tip end of the original mast in a rigid manner for forming the mast extender for a sailboat.

14 Claims, 7 Drawing Sheets

MAST EXTENDER FOR A SAILBOAT

FIELD OF THE INVENTION

The present invention relates to a mast extender for a sailboat. More particularly, it relates to a mast extender having a hollow tubular member having a sealed end at one end and a mast receiving opening at the other end with a waterproof gasket thereon for receiving a distal end of an original sailboat mast in order to extend and lengthen the mast between 18 to 24 inches.

BACKGROUND OF THE INVENTION

Telescoping masts for sailboats are well known in the prior art. These telescoping or collapsible tubular masts employ diverse clamping or locking mechanisms to maintain the mast in an extended position requiring physical manipulative efforts at various points along the length of the mast to enable it to be collapsed. Furthermore, such extending devices are heavy and cumbersome and are more directed towards a one time use, such as in erecting a flag pole. Sailing vessels require a light flexible mast structure, which in order to be effective, must be adapted to support a mainsail along a line disposed about the main mast. Typical telescoping masts are mechanically complicated in structure having a plurality of movable components and gaskets that are easily dislodged upon extending or retracting the collapsible tubular mast.

There remains a need for a non-telescoping or non-collapsible tubular mast that detachably or permanently extends and lengthens an original mast of a sailboat by 18 inches to 24 inches. Further, there is a need for the mast extender to be watertight for allowing the entire mast to float if the sailboat was to capsize. Additionally, the mast extender should allow for added sailing tackle for improved sailing techniques and maneuverability, as well as sailing safety as the sailing boom is increased in height and is less likely to hit or strike the crew in the head when sailing or tacking.

DESCRIPTION OF THE PRIOR ART

Telescoping masts, collapsible tubular masts, extending air foil sails and the like having various designs, configurations, structures and materials of construction have been disclosed in the prior art. For example, U.S. Pat. No. 6,526,901 to IACOBONI discloses a retractable mast for sailboats. The mast, which retracts telescopically, includes an inner core containing air sealed air chambers, either separated or coextensive, which are pressurized when the mast is fully extended. A compressed air bottle or air compressor driven by the boat engine supplies pressurized air to raise the mast. This prior art patent does not disclose or teach the structure, configuration and design of the mast extender for sailboats of the present invention.

U.S. Pat. No. 6,000,354 to VANLERBERGHE discloses a telescoping mast for a sailboat. The mast includes two portions, an upper telescoping portion which is journalled to telescope up from and retract down into the lower portion (trunk). The telescoping portion is raised by a line attached to the bottom portion of the telescoping portion and runs to the top of the trunk. The line then is captured by a pulley whereby the line is redirected down the outside of the mast trunk to the deck area. The telescoping portion, when extended (telescoped), is secured in place to the trunk portion by a pivoting fork journalled within the telescoping portion. This prior art patent does not disclose or teach the structure, configuration and design of the mast extender for sailboats of the present invention.

U.S. Pat. Nos. 8,164; 3,598,075; 4,016,823; 4,047,492; and 5,263,429 all disclose various designs and structures of telescoping masts for sailboats. These prior art patents do not disclose or teach the structure, configuration and design of the mast extender for sailboats of the present invention.

None of the prior art patents disclose or teach a mast extender designed as a single unitary construction for the addition of the mast extender to an original mast on a sailboat.

Accordingly, it is an object of the present invention to provide a mast extender for a sailboat having a hollow tubular member with a sealed end at the distal end and a mast receiving opening at the proximal end for extending the overall mast length of a sailboat.

Another object of the present invention is to provide a mast extender for a sailboat wherein the mast receiving opening at the proximal end of the hollow tubular member includes a waterproof gasket thereon for receiving a distal end of a sailboat mast in order to extend and lengthen the original mast between 18 inches to 24 inches.

Another object of the present invention is to provide a mast extender for a sailboat being watertight that allows the entire mast to float if the sailboat capsizes.

Another object of the present invention is to provide a mast extender for a sailboat that allows for added sailing tackle for improved sailing techniques and maneuverability by a skipper.

Another object of the present invention is to provide a mast extender for a sailboat that allows for added sailing tackle to the cockpit area of the sailboat for increased sailing safety by the skipper for providing quicker emergency reefing and/or lowering of the main sail from the cockpit area of the sailboat.

Another object of the present invention is to provide a mast extender for a sailboat that increases sailing safety by increasing the height of the sailing boom in order to lessen the likelihood of a crew member being hit in the head by the boom when sailing or tacking the sailboat.

Another object of the present invention is to provide a mast extender for a sailboat that is of a single unitary construction for adding length to an original mast on a sailboat.

Another object of the present invention is to provide a mast extender for a sailboat that is simple to install and use, is easy to maintain, and is capable of withstanding everyday wear and tear by saltwater or freshwater.

A further object of the present invention is to provide a mast extender for a sailboat that can be mass produced in an automated and economical manner and is readily affordable by the consumer.

SUMMARY OF THE INVENTION

In accordance with the present invention, there is provided a mast extender for extending a mast of a sailboat to a greater height. The mast extender includes a hollow tubular member having a distal end and a proximal end and being substantially elliptically-shaped. The distal end of the hollow tubular member includes a sealed end. The hollow tubular member includes the sealed end, a first curved side wall, a second curved side wall, curved end walls, and an interior wall surface for forming an interior mast compartment. The proximal end of the hollow tubular member includes a mast receiving opening having a watertight gasket fixedly attached to the interior wall surface; the watertight gasket being adjacent to the mast receiving opening. The first and second curved side walls include aligned fastening bolt openings. The mast extender further includes a fastening bolt extending through the fastening bolt openings and a hex nut for fastening the fastening bolt thereon. The mast extender also includes a distal tip end on an original mast for insertion through the mast receiving opening within the interior mast compartment; and the distal tip end of the original mast includes a tip opening for receiving the fastening bolt therethrough in order to detachably connect the hollow tubular member and the distal tip end of the original mast in a rigid manner for forming the mast extender for a sailboat.

BRIEF DESCRIPTION OF DRAWINGS

Further objects, features and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT

Figure 1:
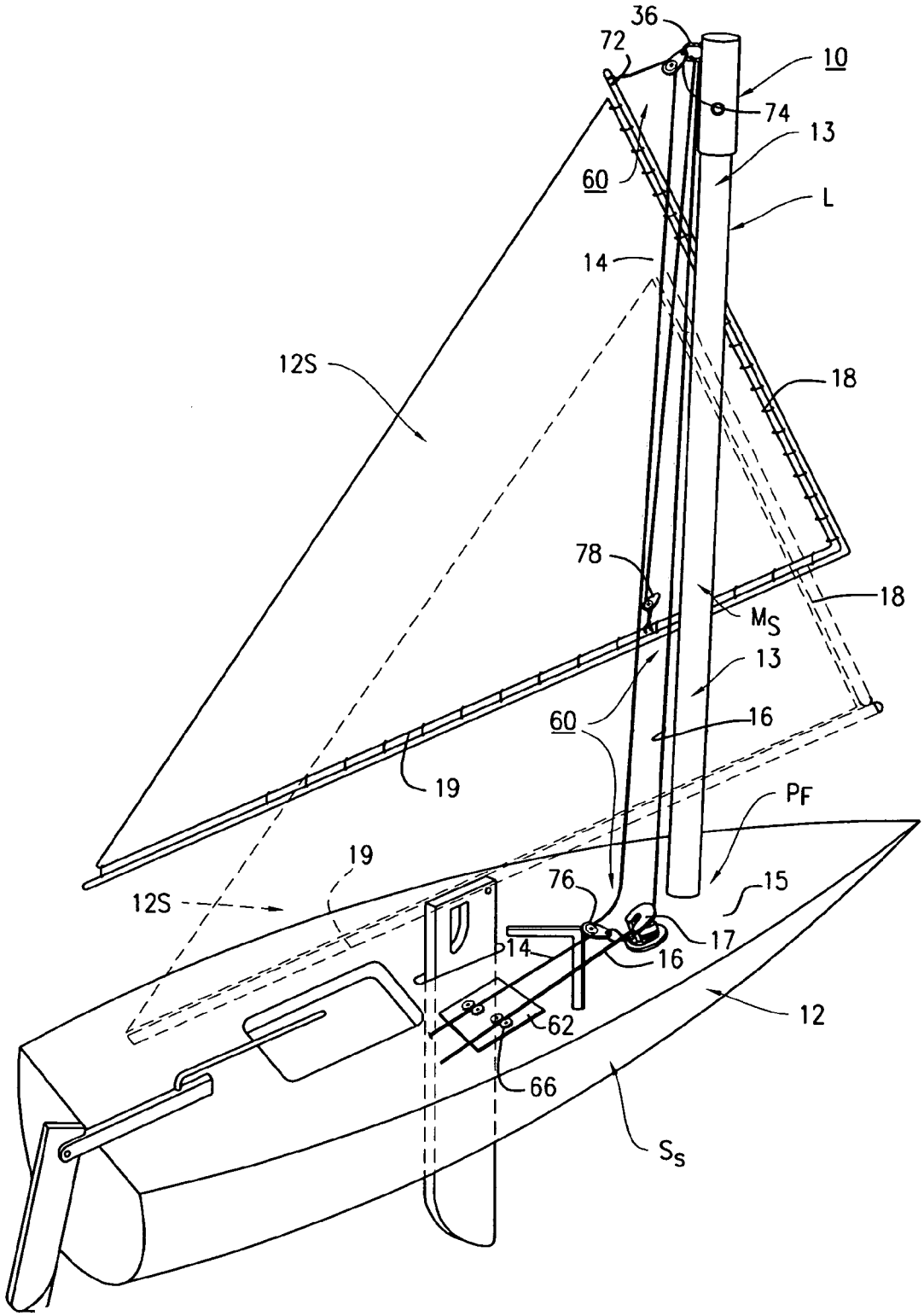
FIG. 1 is a perspective view of the mast extender for a sailboat of the preferred embodiment of the present invention showing the mast extender in an assembled state and in operational use on a sailboat.

The mast extender 10 for a sailboat 12 and its component parts of the preferred embodiment of the present invention are represented in detail by FIGS. 1 through 7 of the patent drawings. The mast extender 10 is used for extending the overall length L of an original mast 13 of sailboat 12 between 18 inches to 24 inches.

As shown in FIGS. 2 through 5, the mast extender 10 includes a hollow tubular member 20 being elliptically-shaped or circularly-shaped having a distal end 22 and a proximal end 24. Hollow tubular member 20 includes a first curved side wall 26, a second curved side wall 28 and curved end walls 30 and 32. The hollow tubular member 20 can be made from durable, rigid and moldable plastic or made from light-weight, tubular metals such as aluminum, stainless steel or titanium, or made from wood materials such as oak, maple, ash and the like. The distal end 22 of hollow tubular member 20 includes a sealed end member 34. The curved side walls 26 and 28, curved end walls 30 and 32 and the sealed end member 34 form an interior mast compartment 35. The distal end 22 of hollow tubular member 20 also includes a U-bolt line fastener 36 attached to one of the curved end walls 30 for attaching an upper boom sail halyard 14 thereto. Each of the curved side walls 26 and 28 include fastening bolt openings 38 and 40 for receiving a fastening-bolt 42 and hex nut 44 therethrough. The fastening bolt 42 and hex nut 44 include watertight gaskets 46 attached thereto. The original mast 13 includes a distal tip end 13*d* having a tip opening 13*t* therein. The tip opening 13*t* is for receiving the fastening bolt 42 therethrough, as well as the fastening bolt 42 being received through aligned fastening bolt openings 38 and 40.

Figure 3:
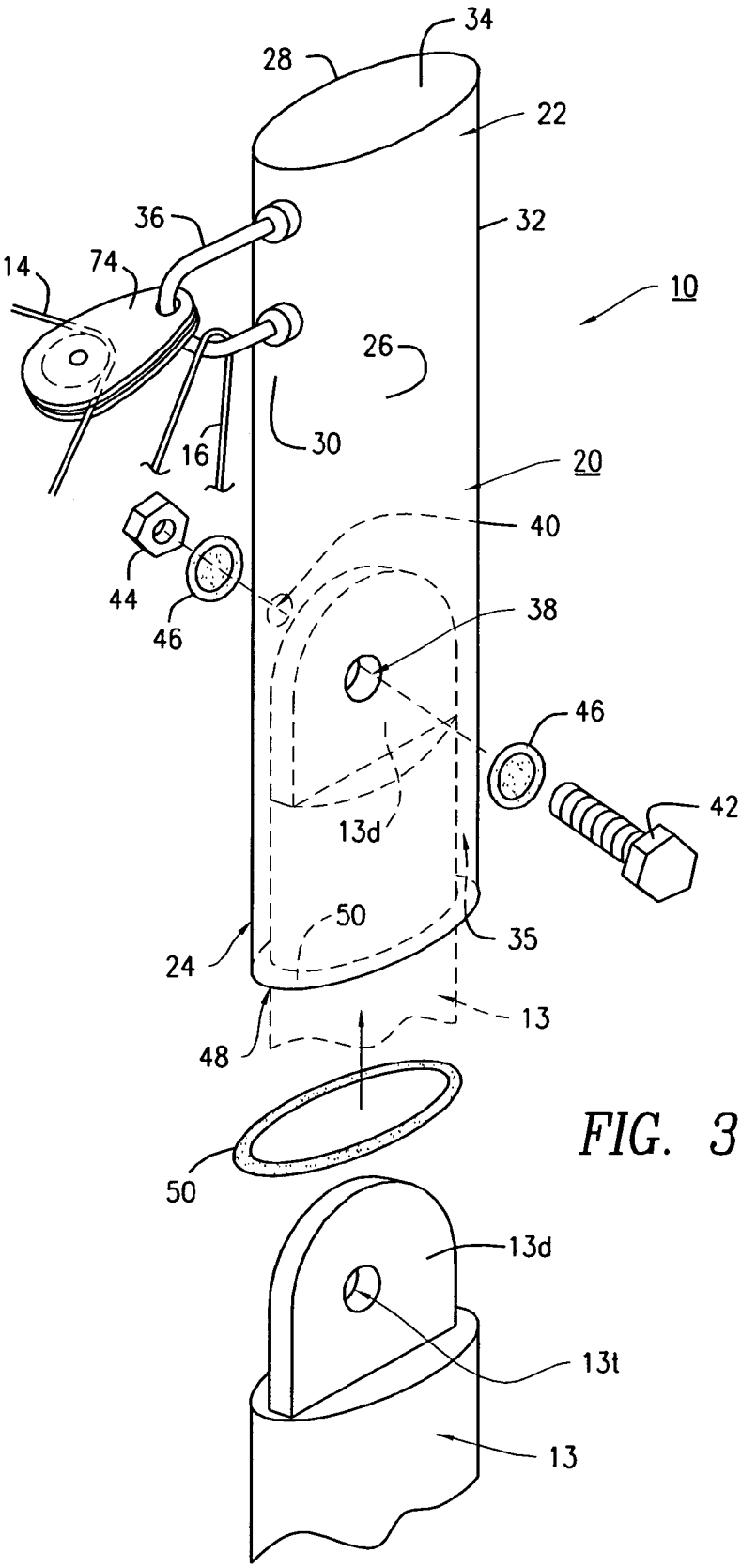
FIG. 3 is an exploded perspective view of the mast extender for a sailboat of the present invention showing the mast extender being attached to a distal tip end of an original mast.
Figure 4:
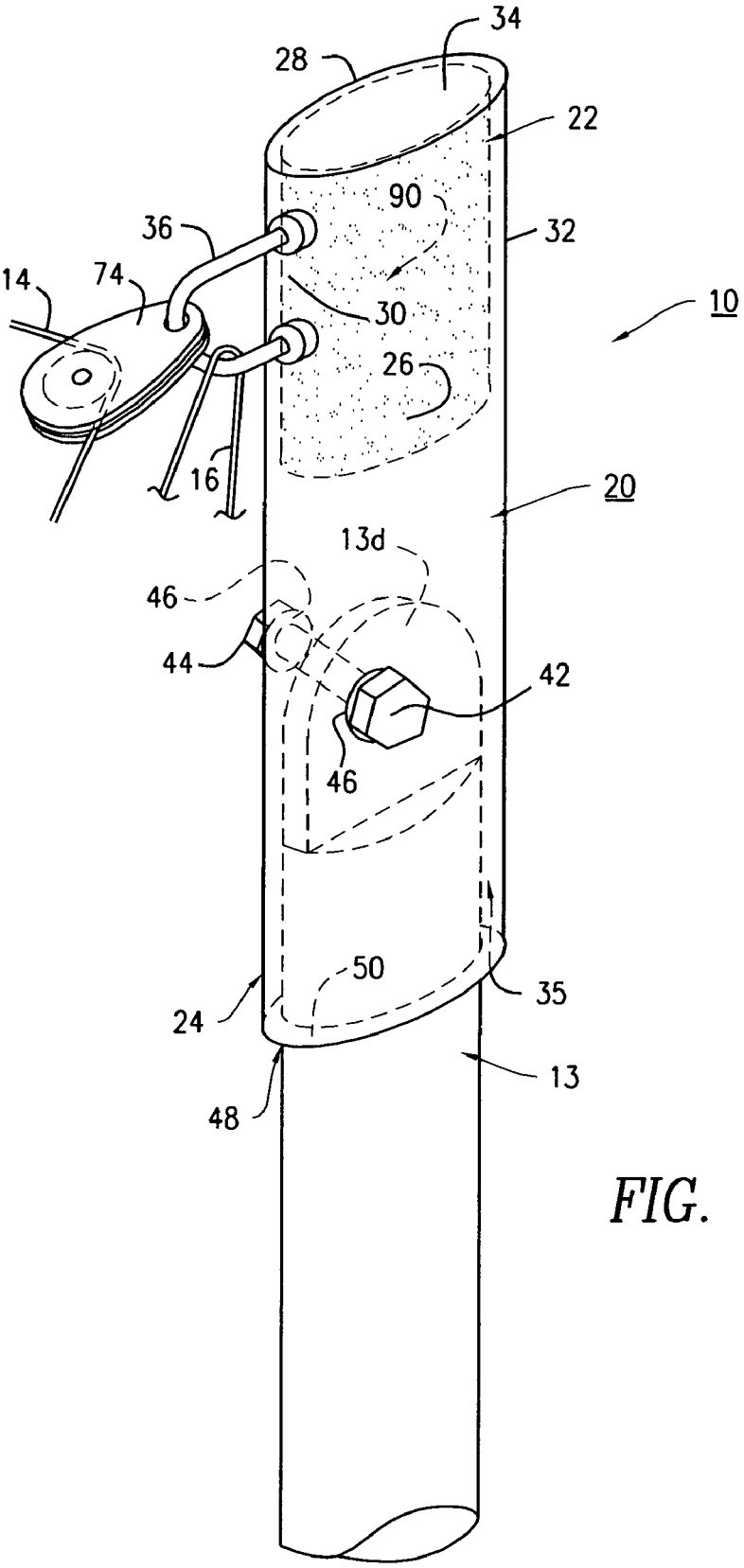
FIG. 4 is an enlarged perspective view of the mast extender of the present invention showing a hollow tubular member and waterproof gaskets attached to the original mast.

The proximal end 24 of hollow tubular member 20 includes a mast receiving opening 48 having an interior watertight gasket 50 fixedly attached to the interior walled surface 52. The watertight gasket 50 is fixedly attached to the interior walled surface 52 by epoxy glue, cement adhesive or laser welding. The watertight gasket 50 is adjacent to mast receiving opening 48. The mast receiving opening 48 of hollow tubular member 20 detachably receives the distal tip end 13*d* of the original mast 13 for the lengthening of original mast 13, as shown in FIGS. 3 and 4 of the drawings. The distal end 13*d* of original mast 13 is detachably received within the mast receiving opening 48 and the interior watertight gasket 50 of hollow tubular member 20 provides for the waterproofing and floating capability of mast extender 10. The mast extender 10 extends the height of the original mast between 18 to 24 inches when in the assembled state, as shown in FIG. 1.

Figure 2:
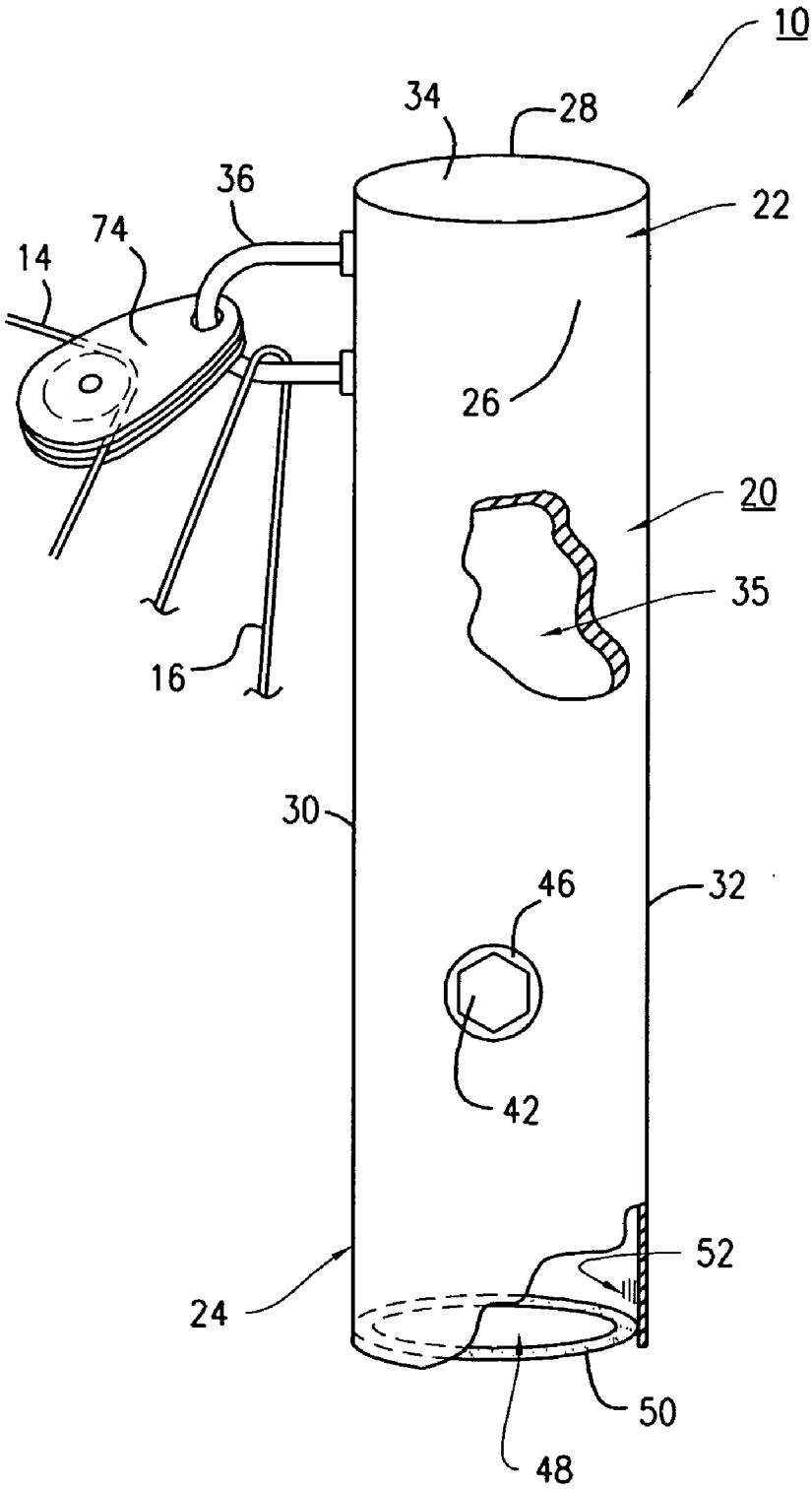
FIG. 2 is a perspective view of the mast extender for a sailboat of the present invention showing the mast extender and its major component parts attached thereto.
Figure 5:
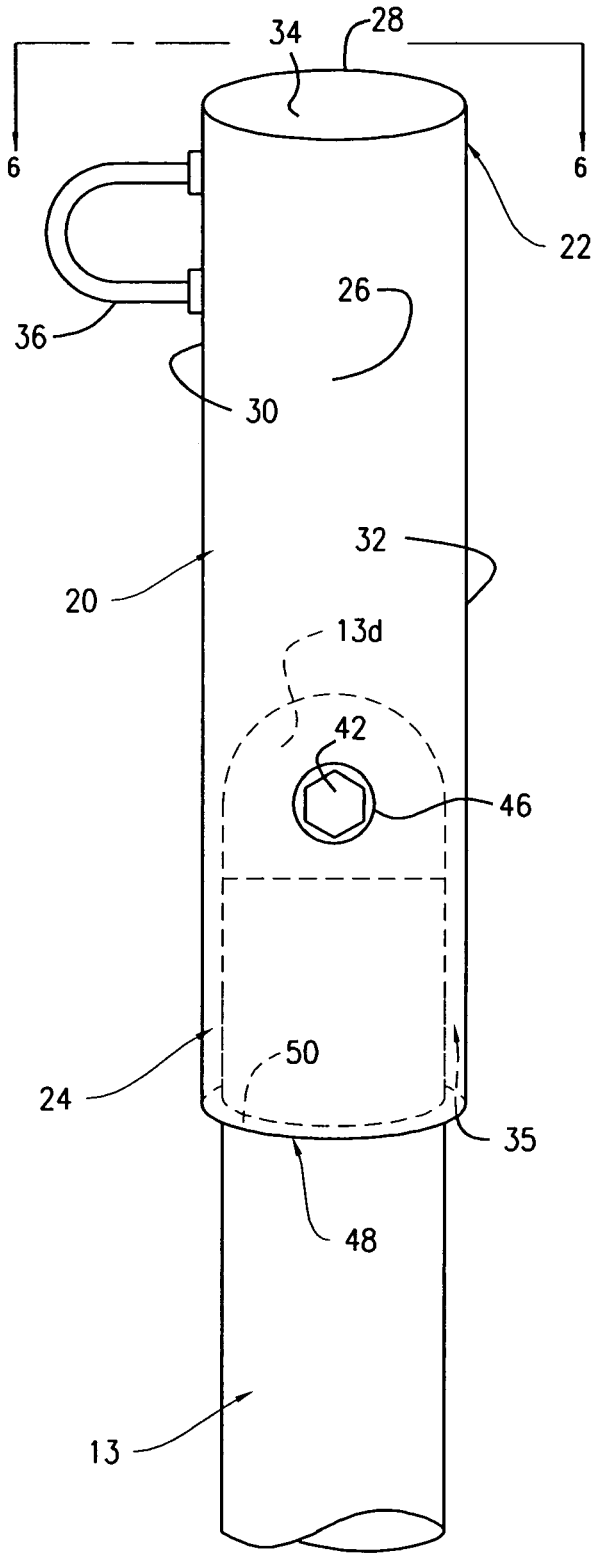
FIG. 5 is an enlarged perspective view of the mast extender of the present invention showing the hollow tubular member and the waterproof gaskets attached to the original mast.
Figure 7:
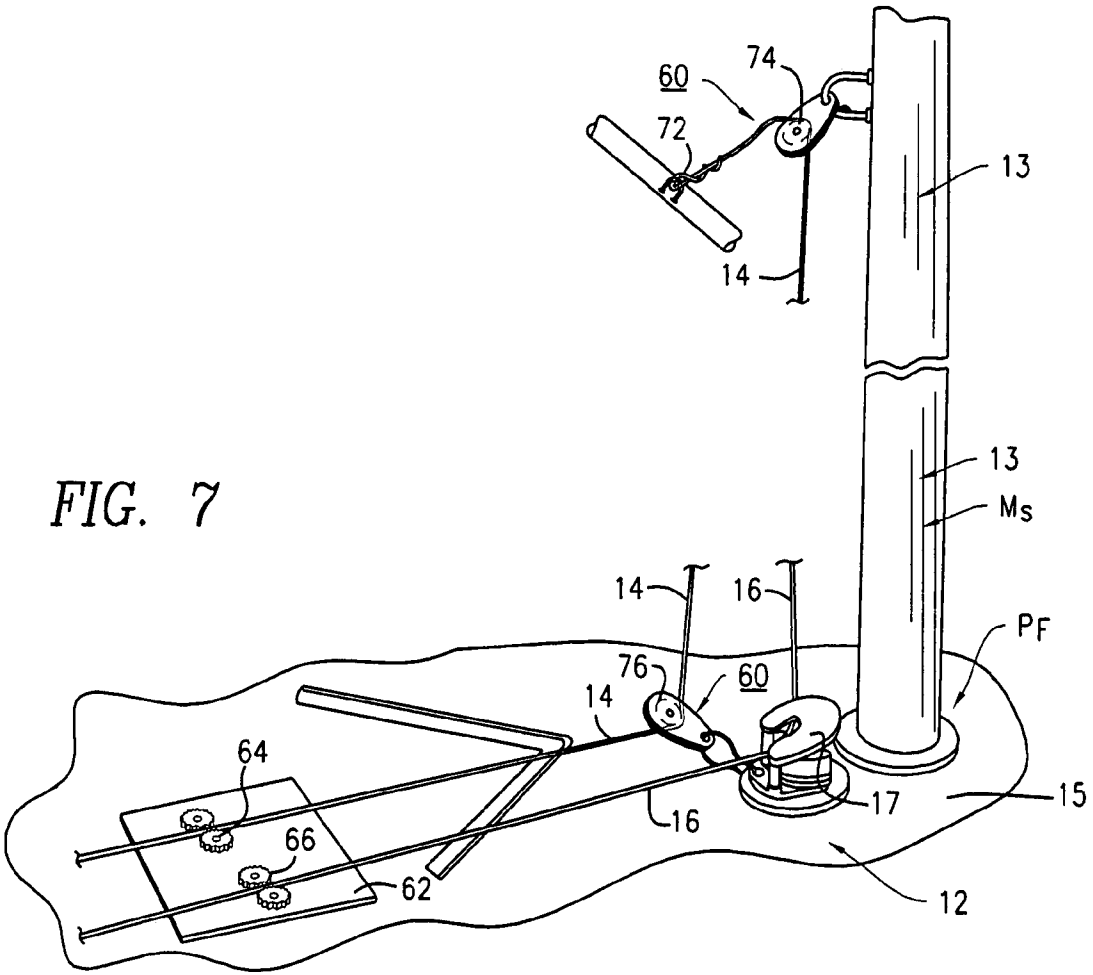
FIG. 7 is a perspective view of the mast extender of the present invention showing a sailboat rigging system and its major component parts attached thereto.

As shown in FIGS. 1, 5 and 7, sailboat 12 further includes a sailboat rigging system 60 in combination with mast extender 10. The sailboat rigging system 60 includes a deck plate 62 connected to a starboard side $S_S$ of an upper deck 15 being positioned at a midship location $M_S$ of sailboat 12. Deck plate 62 can be made from durable materials such as wood, rigid plastic or from metal materials such as stainless steel or brass. The deck plate 62 includes a first cleat member 64 for receiving an upper boom (main sail) halyard 14 therein and a second cleat member 66 for receiving a lower boom halyard 16 therein. The first and second cleat members 64 and 66 can be made from moldable, semi-flexible plastics such as fiberglass or metal materials such as stainless steel or brass or wood materials. Sailboat rigging system 60 also includes an upper boom line fastener 72 being a bowline knot connected to an upper boom single pulley 74, wherein single pulley 74 includes the upper boom halyard 14 detachably connected thereto. The upper boom single pulley 74 is detachably connected to the U-bolt line fastener 36, as depicted in FIG. 2 of the drawings, wherein the upper boom halyard 14 is detachably connected to the bowline knot 72 and single pulley 74. The upper boom halyard 14 is then connected to a deck pulley 76, where then the upper boom halyard 14 is detachably connected to the first cleat member 64 (as previously indicated). Deck pulley 76 is detachably connected to an existing deckloop fairlead 17 via a standard eye-loop shackle 17*s*. The lower boom halyard 16 is detachably fastened through the U-bolt line fastener 36, where then the lower boom halyard 16 is then connected to a lower boom bowline knot 78. The bowline knot 78 is detachably connected to a bowline knot 80, such that bowline knot 80 is fixedly attached to a midpoint position $P_M$ on the lower boom 19, as depicted in FIG. 1 of the drawings. The lower boom halyard 16 is then detachably connected to the existing deckloop fairlead and cam assembly 17 adjacent to the foot position $P_F$ of original mast 13 on upper deck 15, as shown in FIG. 1 of the drawings, where then the lower boom halyard 16 is detachably connected to the second cleat member 66 (as previously indicated). The aforementioned fastener 36, bowline knots 72, 78 and 80, pulleys 74 and 76, cleat members 64 and 66 and deck plate 62 in cooperation with the upper and lower boom halyards 14 and 16 form the sailboat rigging system 60 of the preferred embodiment for allowing the raising and lowering of an upper boom 18 and a lower boom 19, respectively, on sailboat 12, as depicted in FIG. 1 of the drawings. The pulleys 74 and 76, line fasteners being bowline knots 72, 78 and 80, U-bolt line fastener 36, and the existing deckloop fairlead 17 is made from durable and moldable plastic materials thereof.

OPERATION OF THE PRESENT INVENTION

Figure 6:
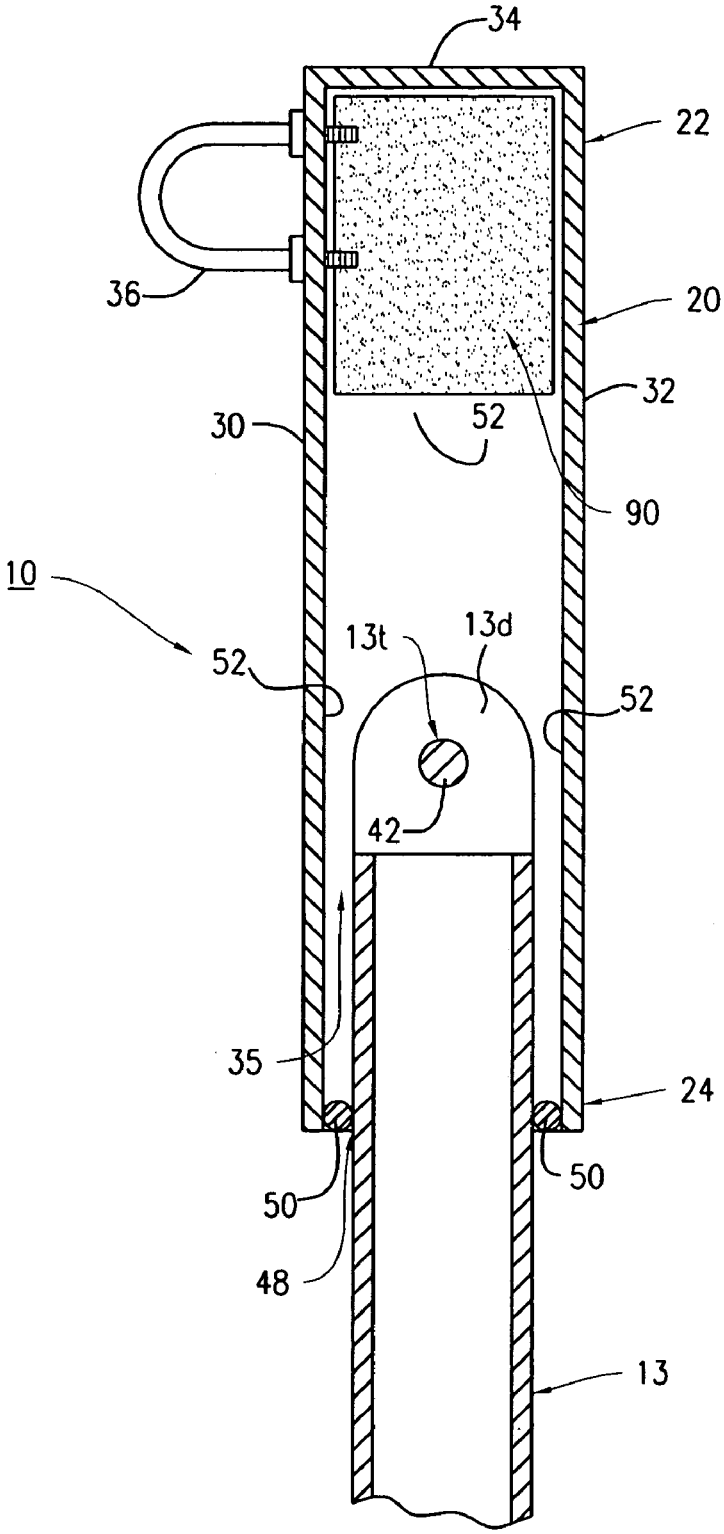
FIG. 6 is a cross-sectional view of the mast extender of the present invention taken along lines 6—6 of FIG. 5 in the direction of the arrows showing the hollow tubular member, the waterproof gaskets, and the original sailboat mast.

In operation, as shown in FIGS. 1 through 7 of the drawings, the mast extender 10 and the sailboat rigging system 60 is assembled and operates in the following manner. In the initial step, as depicted in FIGS. 3 and 4, the distal end 13*d* of the original mast 13 is detachably received within the mast receiving opening 48 of hollow tubular member 20. The user now attaches fastening bolt 42 through fastening bolt openings 38 and 40 of side walls 26 and 28, respectively, as well as a tip opening 13*t* on the distal end 13*d* of original mast 13. The fastening bolt 42 and hex nut 44 are tightened sufficiently such that the watertight gaskets 46 are flush with the outer side walls 26 and 28, respectively, as depicted in FIG. 4. Also, the watertight gasket 50 is flush with the distal end 13*d* of original mast 13 and the mast receiving opening 48, as shown in FIGS. 4 to 6 of the drawings. In an optional configuration, the mast extender 10 can include a shaped piece of styrofoam 90 to help float the mast extender 10 if sailboat 12 were to capsize. Mast extender 10 is now in its assembled state, as shown in FIGS. 4 and 5, and is now ready to be rigged by using the upper and lower boom halyards 14 and 16 within the novel sailboat rigging system 60, respectively, as shown in FIGS. 1 and 7 of the drawings.

In assembling the sailboat rigging system 60, the user attaches a standard shackle 17*s* to the upper boom bowline knot 72 and pulley 74, and then shackle 17*s* is detachably connected to the U-bolt line fastener 36, as depicted in FIGS. 2 to 4 of the drawings. It is understood that pulley 74 can be directly attached to the U-bolt line fastener 36, as depicted in FIG. 5. The upper boom halyard 14 is then detachably connected to the bowline knot 72 and single pulley 74. The upper boom halyard 14 is now attached to the deck pulley 76 and then halyard 14 is detachably connected to the first cleat member 64.

Additionally, deck pulley 76 is then detachably connected to the existing deckloop fairlead 17 by a standard eye-loop line 17*e*. The user now detachably fastens the lower boom halyard 16 through the U-bolt line fastener 36, and then the lower boom halyard 16 is attached to the lower boom bowline knot 78, as shown in FIG. 1. The user then detachably connects the lower boom halyard 16 to the existing deckloop fairlead 17 and finally connects the lower boom halyard 16 to the second cleat member 66, as shown in FIGS. 1 and 7 of the drawings. The aforementioned attachments of halyards 14 and 16 to the various rigging components completes the total rigging of halyards 14 and 16 within the sailboat rigging system 60 of the present invention.

In operation of the sailboat rigging system 60, as shown in FIGS. 1 and 7 of the drawings, the user simply pulls each of the halyards 14 and 16 in order to raise the upper and lower booms 18 and 19, respectively, on sailboat 12, and then cleats each halyard 14 and 16 through first and second cleat members 64 and 66, respectively, for sailboat 12 to be in full operational mode for sailing and/or tacking. To de-rig sailboat 12 the user simply reverses the aforementioned operating procedure as discussed above.

ADVANTAGES OF THE PRESENT INVENTION

Accordingly, an advantage of the present invention is that it provides for a mast extender for a sailboat having a hollow tubular member with a sealed end at the distal end and a mast receiving opening at the proximal end for extending the overall mast length of a sailboat.

Another advantage of the present invention is that it provides for a mast extender for a sailboat wherein the mast receiving opening at the proximal end of the hollow tubular member includes a waterproof gasket thereon for receiving a distal end of a sailboat mast in order to extend and lengthen the original mast between 18 inches to 24 inches.

Another advantage of the present invention is that it provides for a mast extender for a sailboat being watertight that allows the entire mast to float if the sailboat capsizes.

Another advantage of the present invention is that it provides for a mast extender for a sailboat that allows for added sailing tackle for improved sailing techniques and maneuverability by a skipper.

Another advantage of the present invention is that it provides for a mast extender for a sailboat that allows for added sailing tackle to the cockpit area of the sailboat for increased sailing safety by the skipper for providing quicker emergency reefing and/or lowering of the main sail from the cockpit area of the sailboat.

Another advantage of the present invention is that it provides for a mast extender for a sailboat that increases sailing safety by increasing the height of the sailing boom in order to lessen the likelihood of a crew member being hit in the head by the boom when sailing or tacking the sailboat.

Another advantage of the present invention is that it provides for a mast extender for a sailboat that is of a single unit construction for adding length to an original mast on a sailboat.

Another advantage of the present invention is that it provides for a mast extender for a sailboat that is simple to install and use, is easy to maintain, and is capable of withstanding everyday wear and tear by saltwater or freshwater.

A further advantage of the present invention is that it provides for a mast extender for a sailboat that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A mast extender for adding to a mast of a sailboat for extending the mast to a greater height, comprising:

a) a hollow tubular member having a curvlinear cross-section and having a distal end and a proximal end;

b) said distal end of said hollow tubular member including a closed end;

c) said hollow tubular member further including a vertical member and an interior wall surface for forming an interior mast compartment;

d) said proximal end of said hollow tubular member including a mast receiving opening having a watertight gasket fixedly attached to said interior wall surface; said watertight gasket being adjacent to said mast receiving opening;

e) said vertical member including aligned fastening device openings for receiving a fastening device;

f) said fastening device extending through said openings in said tubular member;

g) a distal tip end on an original mast for insertion through said mast receiving opening within said interior mast compartment; and h) said distal tip end of said original mast including a tip opening for receiving said fastening device therethrough in order to detachably connect said hollow tubular member and said distal tip end of said original mast in a rigid manner for adding said mast extender to the original mast of a sailboat in order to extend the height of the original mast in order to position the boom at a higher elevation.

2. A mast extender in accordance with claim 1, wherein said distal end of said hollow tubular member includes an upper U-bolt line fastener attached to said vertical member for receiving and attaching an upper boom halyard thereto.

3. A mast extender in accordance with claim 1, wherein said vertical member includes a lower U-bolt line fastener being attached at a midpoint position on said original mast for receiving and attaching a lower boom halyard thereto.

4. A mast extender in accordance with claim 1, wherein said fastening device openings include watertight bolt gaskets thereon for water proofing of said hollow tubular member when in an assembled state with said original mast.

5. A mast extender in accordance with claim 1, wherein said watertight gasket is fixedly attached to said interior wall surface by epoxy glue, cement adhesive or laser welding for water proofing of said hollow tubular member when in an assembled state with said original mast.

6. A mast extender in accordance with claim 1, wherein said interior mast compartment includes an elliptically-shaped piece of styrofoam in order to allow said mast extender to float if said sailboat were to capsize.

7. A mast extender in accordance with claim 1, wherein said mast extender lengthens said original mast between 18 to 24 inches when in an assembled state with said original mast.

8. A mast extender in accordance with claim 1, wherein said hollow tubular member is made from durable, rigid and moldable plastic.

9. A mast extender in accordance with claim 1, wherein said hollow tubular member is made from light-weight, metal tubing such as aluminum, stainless steel or titanium.

10. A sailboat rigging system in cooperation with a mast extender for increased maneuverability and safety when sailing and tacking of a sailboat, comprising:

a) a mast extender for extending the length of an original mast of a sailboat; said mast extender having a distal end and a proximal end;

b) an upper U-bolt member connected to a curved end wall of said distal end of said mast extender;

c) a deckloop fairlead attached to an upper deck section of said sailboat at the foot of said original mast;

d) a deck plate attached to said upper deck section of said sailboat being adjacent to a cockpit of said sailboat;

e) said deck plate including a first cleat member and a second cleat member; said first and second cleat members attached to said deck plate;

f) an upper pulley, an upper boom line fastener and said upper pulley detachably connected to said upper U-bolt member;

g) a lower boom line fastener and said lower boom line fastener detachably connected to lower boom;

h) a lower deck pulley and a third shackle detachably connected to said deckloop fairlead;

i) an upper boom halyard detachably connected and movable within said upper pulley and said upper boom line fastener, said upper boom halyard detachably connected and movable within said lower deck pulley and said upper boom halyard detachably connected and movable within said first cleat member for raising and lowering of an upper boom of said sailboat; and j) a lower boom halyard detachably connected and movable within said upper U-bolt member, said lower boom halyard detachably connected and movable within said lower boom line fastener, said lower boom halyard detachably connected and movable within said deckloop fairlead and said lower boom halyard detachably connected and movable within said second cleat member for raising and lowering of a lower boom of said sailboat.

11. A sailboat rigging system in accordance with claim 10, wherein said pulleys, said fasteners, said U-bolt members, said deckloop fairlead are made from saltwater-resistant materials selected from the group consisting of stainless steel, brass, durable plastic, and combinations thereof.

12. A sailboat rigging system in accordance with claim 10, wherein said deck plate is made from saltwater-resistant materials selected from the group consisting of durable and rigid plastic and wood materials.

13. A sailboat rigging system in accordance with claim 10, wherein said deck plate is made from saltwater-resistant materials selected from the group consisting of stainless steel and brass.

14. A sailboat rigging system in accordance with claim 10, wherein said cleat members are made from saltwater-resistant materials selected from the group consisting of stainless steel, brass, semi-flexible and moldable plastics and combinations thereof.

* * * * *